United States Patent [19]

Nicholas

[11] 4,432,158

[45] Feb. 21, 1984

[54] BALANCING BIRD

[76] Inventor: William M. Nicholas, Route 2, Box 660-K, Golden, Colo. 80403

[21] Appl. No.: 470,547

[22] Filed: Feb. 28, 1983

[51] Int. Cl.[3] ..... A63H 13/00

[52] U.S. Cl. ..... 46/131; 46/124

[58] Field of Search ..... 428/16; 46/124, 131

[56] References Cited

U.S. PATENT DOCUMENTS

| | | | |
|---|---|---|---|
| 682,519 | 9/1901 | Bartholomew | 46/124 X |
| 840,727 | 1/1907 | Whitehouse | 46/131 |
| 3,040,476 | 6/1962 | Green | 46/124 X |
| 3,402,929 | 9/1968 | Glass et al. | 46/131 X |

*Primary Examiner*—Henry F. Epstein

[57] ABSTRACT

This invention is a simulated bird in hovering flight, including a bird figurine having spread wings and a tail forming three spaced-apart counterweights for a beak of the figurine, which is rested upon an upper end of an upright post.

1 Claim, 6 Drawing Figures

Fig.1
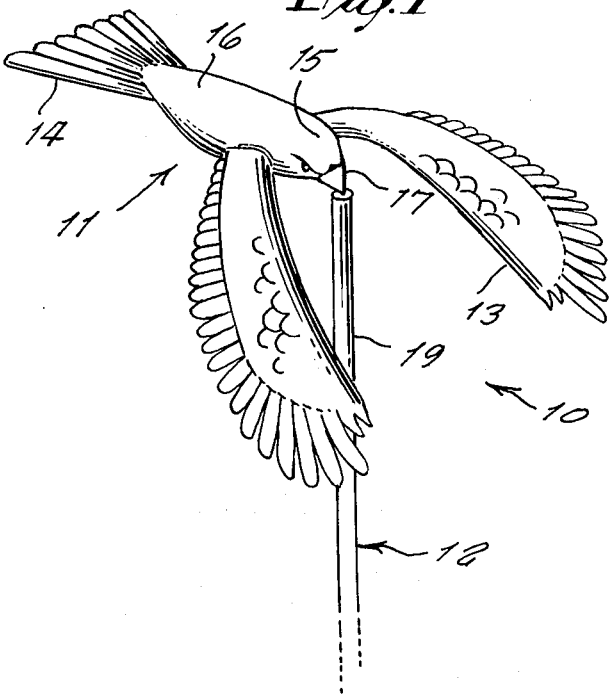
Fig.2
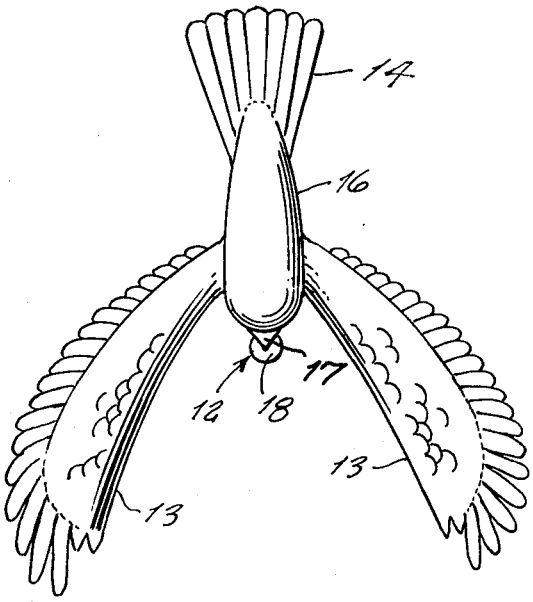
Fig.4
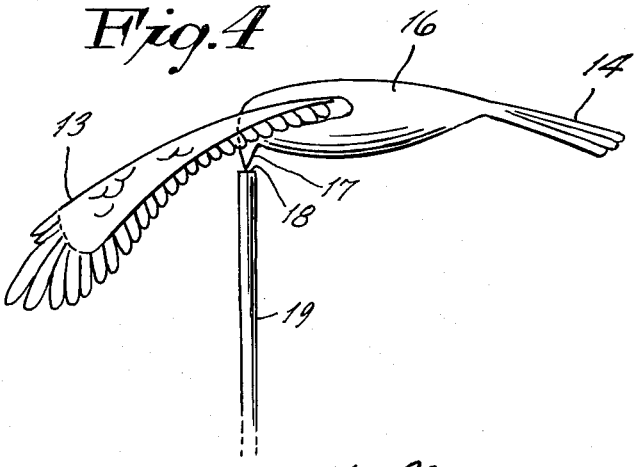
Fig.3
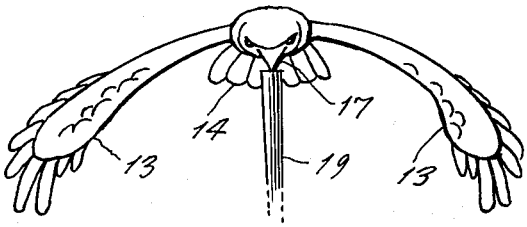
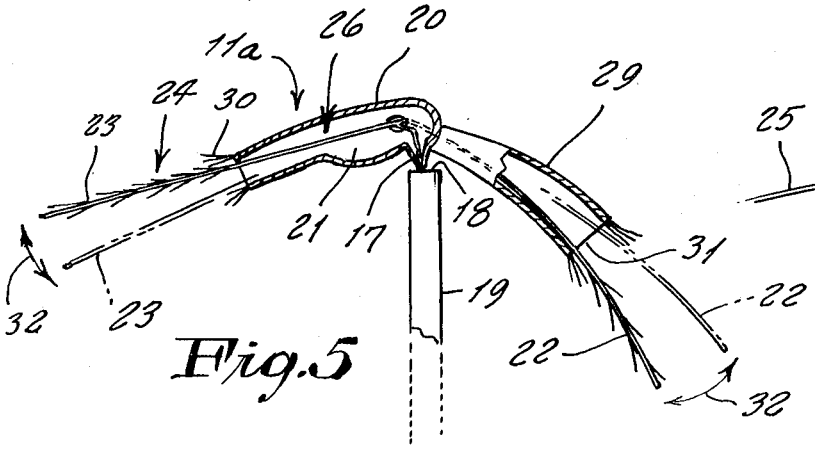
Fig.5
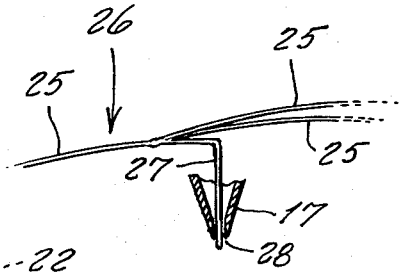
Fig.6

BALANCING BIRD

This invention relates generally to gravitationally self-balanced display novelties. More specifically, it relates to a model of a bird in animated flight.

It is well known that numerous designs of self-balanced figurines have been made in the past for purpose of decoration, demonstration or instruction, in which the principles of material physics produce wonder or amusement to visually behold.

It is a principal object of the present invention to provide a figurine of a bird, and which is balanced upon a stationary pedestal, so that, in a slight breeze, it freely moves thereupon, and gives an animated illusion of an actual hovering flight, thus differing from a figurine in a suspended mobile.

Another object is to provide a balanced bird figurine, which may be made in any size, and which is accurately detailed, in order to look realistically like an actual bird.

Yet a further object is to provide a balanced bird figurine, which may be in a collection representing various different species of birds, in order that such a set may be collected by interested persons.

Other objects are to provide a balancing bird, which is simple in design, inexpensive to manufacture, rugged in construction, easy to use, and efficient in operation.

These, and other objects, will be readily evident, upon a study of the following specification, and the accompanying drawing, wherein:

FIG. 1 is a perspective view of the invention;

FIG. 2 is a top plan view thereof;

FIG. 3 is a front elevational view thereof;

FIG. 4 is a side elevational view thereof;

FIG. 5 is a side elevational view, shown partly in cross-section, and illustrating a modified design of the invention, in which the outer ends of the tail and the wings can flap independently of the main body, so as to give additional animated realism to the bird, and FIG. 6 is an enlarged detail of the pivot structure shown in FIG. 5, shown illustrated in the same plane.

Referring now to the drawing in greater detail, and more particularly to FIGS. 1 to 4 thereof, at this time, the reference numeral 10 represents a balancing bird assembly, according to the present invention, wherein there is a bird figurine 11, which is supported upon an upper end of a pole 12.

The figurine is a scale replica of any species of bird, and is shown in flight position, with its wings 13 spread open, and its tail 14 flared out, while the head 15, at an end of the body 16, is tilted slightly, so that its beak 17 is pointed downwardly, and is thus able to rest upon a small, horizontal, flat surface 18 formed on the upper end of the pole. The wings and the tail are each tilted slightly downwardly, in order that the body 16, from which they radially extend, is at a higher elevation; the wings and tail thus forming three spread apart low counterweights for maintaining the figurine in a self-balanced condition, when the beak 17, at higher level, is rested upon the pole. The shaft 19 of the pole may be made to extend downwardly either vertically or at an angle, and its shape may be either straight, or irregular like a tree's branches. The lower end of the shaft may be mounted upon a rigid base (not shown), for being stationarily supported.

The figurine may be made of any material, and in any desired size, being colored and contoured in detail, as preferred. In use, it may be placed either upon a desk, table or other place where a passing slight breeze may occasionally move the balanced figurine and produce an animated bird hovering action.

In a modified design of bird figurine 11*a*, shown in FIGS. 5 and 6, the figurine comprises a hollow shell 20 around a central interior 21, and the outer ends 22 of the wings and the outer end 23 of the tail are not made integrally with the figurine body, but are made a separate unit 24 therefrom, and which has its own independent movement respective thereto, so as to increase realism in the appearance of flight. In this design, the wing ends 22 and the tail end 23 are affixed on the ends of three metal rods 25, which are joined together to form a single rigid metal frame 26, that also includes a short downward spur 27, protruding outwardly through a small hole 28 at the tip of the beak, so that the spur may also rest and pivot upon the surface 18 of the pole. The base end 29 of each wing, and the base end 30 of the tail are made integral with the figurine body, and each includes a wide opening 31 at its outer end, through which the wing outer ends 22 and tail outer end 23 protrudes.

Thus, in operative use, the unit 24 pivots freely inside the shell 20, so that the outer ends of the wings and tail include an additional movement from the body movement of the figurine, suggesting jointed appendages, as indicated by the arrows 32. The wide openings 31 may comprise simply vertical slots, if preferred, so as to confine this additional movement only to a vertical flapping action.

While various changes may be made in the detail construction, it is understood that such changes will be within the spirit and scope of the present invention, as is defined by the appended claims.

What I now claim as new, is:

1. A balancing bird assembly, comprising, in combination, a bird figurine depicting a bird in flight and a pole upon which said bird figurine is supported in a balanced condition; said bird figurine including a body having a head at a forward end thereof, a downward beak on said head, a rearward tail and a pair of opposite, sideward wings, said tail and said wings forming spread-apart, balancing counterweights for said figurine when said beak is rested upon said post; said body comprising a hollow, rigid shell including said head, said beak, and base portions of said tail and said wings, an independently pivotable unit inside said body comprising a rigid frame including a downwardly spur protruding out of a hole through a tip of said beak for resting also upon said post, and outward end portions of said tail and said wings protruding out of wide openings through ends of said tail base portion and said wing base portions; an upper end of said post including a horizontal, small surface upon which said beak and said spur may pivot; and a lower end of said post is mounted upon a rigid base.

* * * * *